US007800546B2

(12) United States Patent
Rao et al.

(10) Patent No.: US 7,800,546 B2
(45) Date of Patent: Sep. 21, 2010

(54) MOBILE WIRELESS COMMUNICATIONS DEVICE INCLUDING MULTI-LOOP FOLDED MONOPOLE ANTENNA AND RELATED METHODS

(75) Inventors: Qinjiang Rao, Waterloo (CA); Geyi Wen, Waterloo (CA)

(73) Assignee: Research In Motion Limited, Ontario (CA)

( * ) Notice: Subject to any disclaimer, the term of this patent is extended or adjusted under 35 U.S.C. 154(b) by 208 days.

(21) Appl. No.: 11/850,751

(22) Filed: Sep. 6, 2007

(65) Prior Publication Data

US 2009/0066586 A1 Mar. 12, 2009

(51) Int. Cl.
*H01Q 1/22* (2006.01)

(52) U.S. Cl. ..... 343/702; 343/700 MS; 343/797; 343/853; 343/860; 343/895

(58) Field of Classification Search ..... 343/702, 343/742, 767, 770, 867, 870, 895, 700 MS, 343/797, 853, 860
See application file for complete search history.

(56) References Cited

U.S. PATENT DOCUMENTS

| | | | | |
|---|---|---|---|---|
| 5,412,392 | A * | 5/1995 | Tsunekawa | 343/702 |
| 5,600,341 | A * | 2/1997 | Thill et al. | 343/895 |
| 5,923,305 | A * | 7/1999 | Sadler et al. | 343/895 |
| 6,054,955 | A | 4/2000 | Schlegel, Jr. et al. | 343/702 |
| 6,373,448 | B1 * | 4/2002 | Chun | 343/895 |
| 6,448,934 | B1 * | 9/2002 | Lee et al. | 343/702 |
| 6,683,571 | B2 * | 1/2004 | Ghosh et al. | 343/700 MS |
| 6,806,832 | B2 * | 10/2004 | Sato et al. | 343/700 MS |
| 6,967,631 | B1 * | 11/2005 | Park et al. | 343/895 |
| 6,987,494 | B2 * | 1/2006 | Keren | 343/895 |
| 7,504,997 | B2 * | 3/2009 | Baliarda et al. | 343/700 MS |
| 2003/0058173 | A1 | 3/2003 | Yoon | 343/702 |
| 2003/0058176 | A1 | 3/2003 | Keilen et al. | 343/702 |
| 2004/0130495 | A1 | 7/2004 | Hilgers | 343/702 |
| 2007/0236394 | A1 * | 10/2007 | Aoyama et al. | 343/700 MS |

(Continued)

FOREIGN PATENT DOCUMENTS

| | | |
|---|---|---|
| EP | 1 152 482 A2 | 7/2001 |
| EP | 1 414 108 A2 | 4/2004 |

OTHER PUBLICATIONS

Liu et al., Dual-Frequency Planar Inverted-F Antenna, IEEE Transactions on Antennas and Propagation, vol. 45, No. 9, pp. 1451-1457, Oct. 1997.

(Continued)

*Primary Examiner*—Douglas W Owens
*Assistant Examiner*—Chuc D Tran

(57) ABSTRACT

A mobile wireless communications device may include a portable housing, a printed circuit board (PCB) carried within the portable housing, and wireless communications circuitry carried by the PCB within the portable housing. Furthermore, a folded monopole antenna may be coupled to the wireless communications circuitry. The folded monopole antenna may include a dielectric body having a generally rectangular shape defining a bottom portion adjacent the PCB and a top portion opposite the bottom portion. The antenna may also include a conductive trace having a bottom loop adjacent the bottom portion of the dielectric body, a top loop adjacent the top portion of the dielectric body, and an intermediate wrap-around section extending around the dielectric body and between the bottom and top loops.

21 Claims, 6 Drawing Sheets

U.S. PATENT DOCUMENTS

2008/0042918 A1* 2/2008 Lee ..... 343/848
2009/0231213 A1* 9/2009 Ishimiya ..... 343/702

OTHER PUBLICATIONS

Rowell et al., A Compact PIFA Suitable for Dual-Frequency 900/1800-MHz Operation, IEEE Transactions on Antennas and Propagation, vol. 46, pp. 586-598, Apr. 1998.

Chiu et al, Compact Dual-Band PIFA with Multi-Resonators, Electronic Letters, vol. 38, pp. 538-554, 2002.

Guo et al., Miniature Built-In Quad-Band Antennas for Mobile Handsets, IEEE Antennas and Wireless Propagation Letters, vol. 2, pp. 30-32, 2003.

* cited by examiner

MOBILE WIRELESS COMMUNICATIONS DEVICE INCLUDING MULTI-LOOP FOLDED MONOPOLE ANTENNA AND RELATED METHODS

FIELD OF THE INVENTION

The present invention relates to the field of communications systems, and, more particularly, to mobile wireless communications devices and antennas therefor, and related methods.

BACKGROUND OF THE INVENTION

As the size of mobile wireless communications devices (e.g., cellular devices) decreases, so too does the allowable space for the device antenna. In the near future, a mobile handset, which may operate over multiple frequency bands to provide various communication services (e.g., GSM 850/900/1800/1900 and UNITS 2100) may be required to accommodate more than one antenna to achieve such wideband operation, as well as to provide desired beam forming and/or enhance communications system capacity. As a result, designing small antennas that can meet these technical challenges can be difficult. See, e.g., Wen, "Physical Limitations of Antennas," IEEE Transactions on Antennas and Propagation, vol. 51, no. 8, pgs. 2116-2123, 2003.

Internal planar inverted-F antennas (PIFAs) are commonly used in wireless handset devices. However, one drawback of typical PIFA antennas is that they have a relatively limited (i.e., narrow) frequency bandwidth. See, e.g., Liu et al., "Dual-Frequency Planar Inverted-F Antenna," IEEE Transactions on Antennas and Propagation, vol. 45, no. 9, pgs. 1451-1457, October 1997; Rowell et al., "A Compact PIFA Suitable for Dual-Frequency 900/1800-MHz Operation," IEEE Transactions on Antennas and Propagation, vol. 46, pgs. 586-598, April 1998; and Chiu et al, "Compact Dual-Band PIFA with Multi-Resonators, Electronic Letters," vol. 38, pgs. 538-554, 2002. To enhance the bandwidth of a PIFA, these antennas are sometimes combined with other broadband technologies, such as parasitic elements or multi-layered structures. See, e.g., Quo et al., "Miniature Built-In Quad-Band Antennas for Mobile Handsets, IEEE Antennas and Wireless Propagation Letters," vol. 2, pgs. 30-32, 2003. However, these approaches may result in a larger PCB surface area to implement, as well as complicating the manufacture process. Moreover, it may be somewhat challenging to tune the resonant frequencies of a PIFA with resonant branches.

Another form of antenna, the monopole antenna, typically has a relatively wide bandwidth as compared with that of a PIFA. However, a significant drawback of typical monopole antennas is that they require a relatively large surface area (i.e., they are larger) than a comparable PIFA. Another drawback of monopole antennas is that, due in part to the size constraints, when they are implemented in a handheld device they are typically implemented as external antennas, which results in an undesirable form factor for users. PIFAs, on the other hand, are relatively easy to implement as internal antennas.

Even so, another advantage that a monopole antenna has over the PIFA, in addition to its wideband response, is its isolation from the surrounding environment, and, more specifically, the ground plane. Monopole antennas are also comparatively simpler, and have a relatively low profile.

One exemplary monopole antenna arrangement is set forth in U.S. Pat. No. 6,054,955 to Schlegel, Jr., et al. This patent is directed to an antenna arrangement for use in the housing of a portable communications device. The antenna arrangement includes a pair of spaced folded monopole antennas. Each antenna includes a first printed circuit board having a conducting surface that forms a ground plane. Mounted on the first circuit board is a second printed circuit board having a right-angled strip of conducting material, which forms a folded monopole radiating element. The folding of the monopole reduces its height, to thereby enable it to fit into small casings and the like. To compensate for the effects of the folded monopole on the electrical match, frequency bandwidth and electromagnetic fields, a shunt inductance is introduced between the monopole and the ground plane. The antennas are mounted within cavities that can be lined or coated with metallic material to improve the radiation patterns of the antennas and isolate them from the electronic components of the communications system.

Despite the existence of such antenna arrangements, further advancements in monopole antenna structures for mobile wireless communications device may be desirable in some applications.

DETAILED DESCRIPTION OF THE PREFERRED EMBODIMENTS

Figure 1:
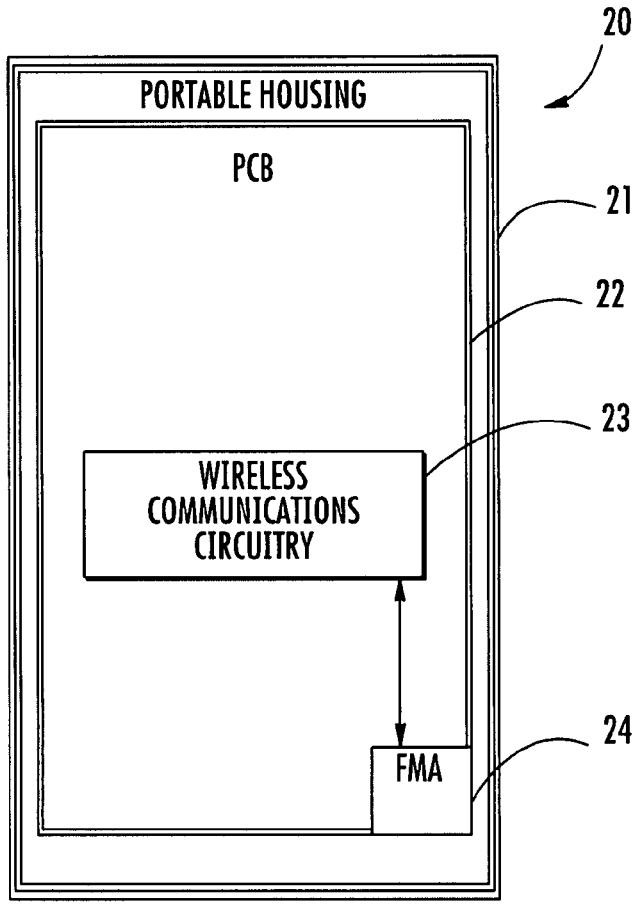
FIG. 1 is a schematic block diagram of a mobile wireless communications device in accordance with an exemplary embodiment including a folded monopole antenna (FMA).
Figure 2:
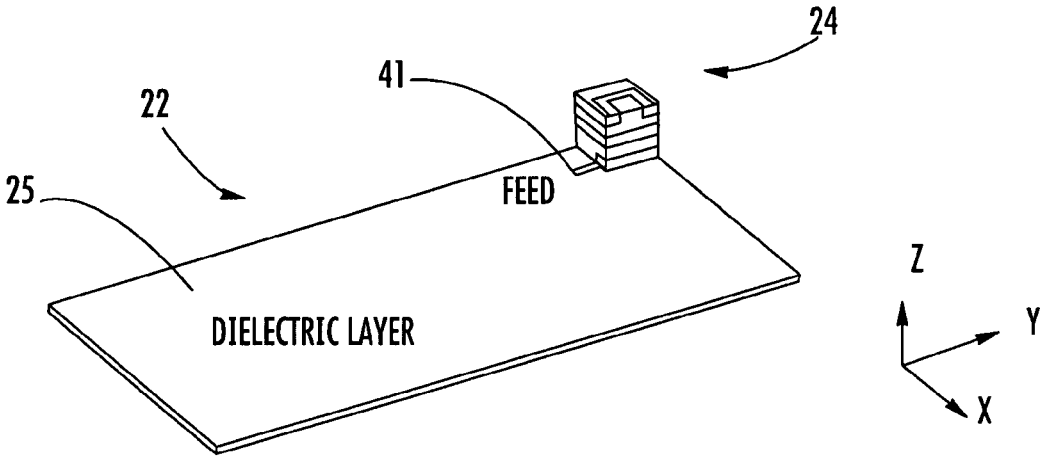
FIG. 2 is a top perspective view of a printed circuit board (PCB) having a folded monopole antenna thereon in accordance with one aspect.
Figure 3:
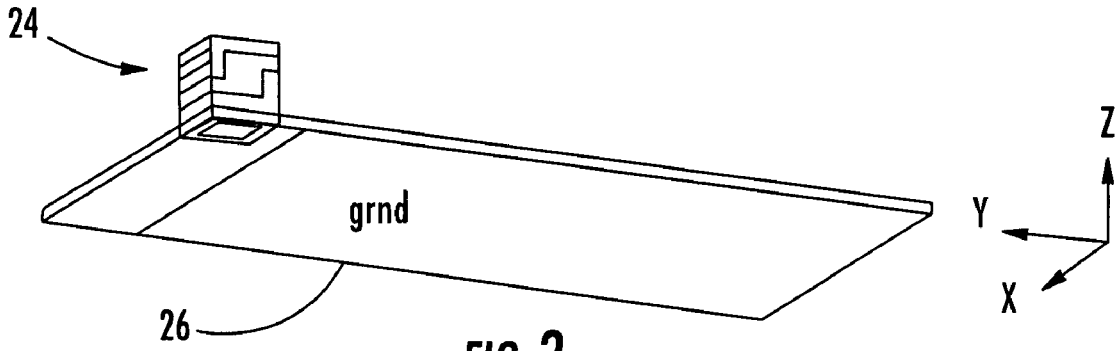
FIG. 3 is a bottom perspective view of the PCB and folded monopole antenna of FIG. 2.
Figure 4A:
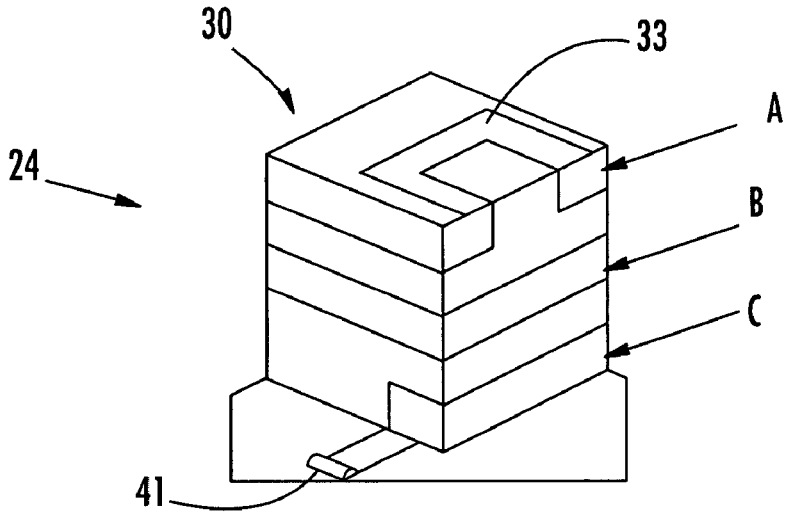
FIGS. 4A and 4B are enlarged perspective views of the folded monopole antenna as seen in FIGS. 2 and 3, respectively.
Figure 4B:
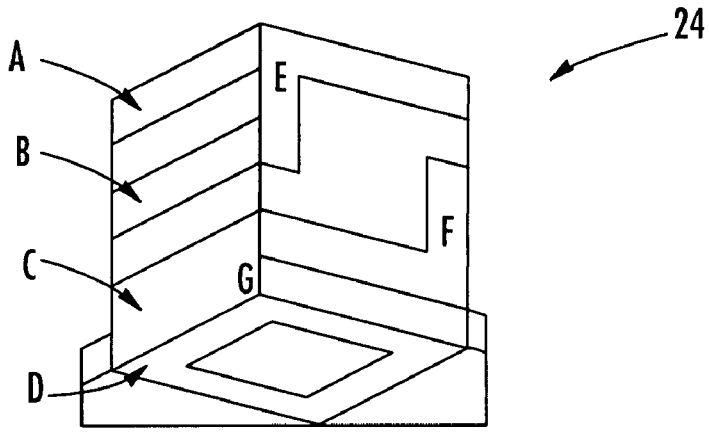
Figure 5A:
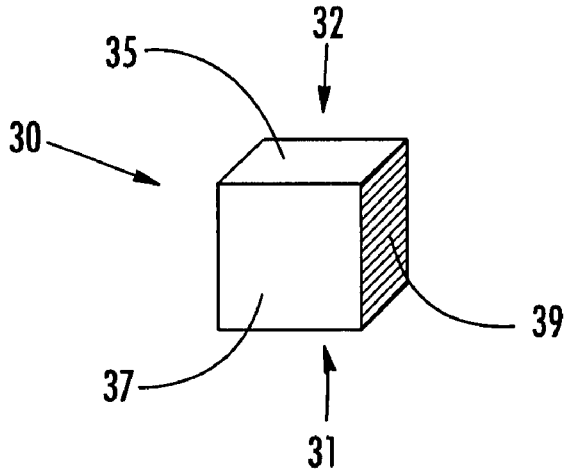
FIGS. 5A and 5B are enlarged perspective views of the dielectric body of the folded monopole antenna as seen in FIGS. 2 and 3 respectively, with the conductive trace removed.
Figure 5B:
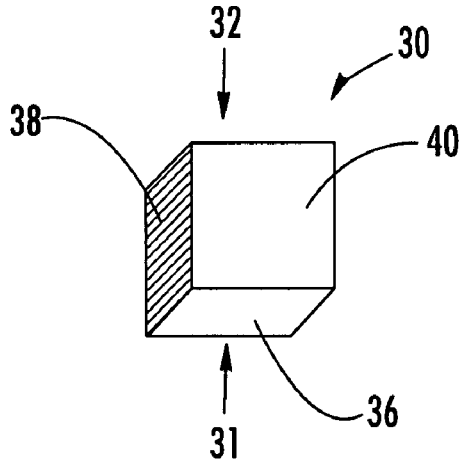

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Generally speaking, a mobile wireless communications device is disclosed herein which may include a portable housing, a printed circuit board (PCB) carried within the portable housing, and wireless communications circuitry carried by the PCB within the portable housing. Furthermore, a folded monopole antenna may be coupled to the wireless communications circuitry. In particular, the folded monopole antenna may include a dielectric body having a generally rectangular shape defining a bottom portion adjacent the PCB and a top portion opposite the bottom portion. The antenna may also include a conductive trace having a bottom loop adjacent the bottom portion of the dielectric body, a top loop adjacent the top portion of the dielectric body, and an intermediate wrap-around section extending around the dielectric body and between the bottom and top loops.

More particularly, the conductive trace may further comprise a feed section adjacent the bottom portion of the dielectric body and electrically coupled to the wrap-around intermediate section. The dielectric body may have opposing top and bottom faces, opposing first and second end faces, and opposing first and second side faces. As such, the intermediate wrap-around section may define a generally rectangular coil around the first and second end faces and the first and second side faces. Further, the top loop may extend along the first and second end faces, the first and second side faces, and the top face of the dielectric body. The bottom loop may extend along the bottom face of the dielectric body for example.

In accordance with one embodiment, the dielectric body may comprise a dielectric cube. The wireless communications circuitry may comprise a cellular transceiver, for example. Additionally, the folded monopole antenna may advantageously operate over a plurality of radio frequency (RF) communications bands.

A folded monopole antenna, such as the one described briefly above, and a method for making the same are also provided. The method may include forming a dielectric body having a generally rectangular shape defining a bottom portion and a top portion opposite the bottom portion. Furthermore, a conductive trace may be formed having a bottom loop adjacent the bottom portion of the dielectric body, a top loop adjacent the top portion of the dielectric body, and an intermediate wrap-around section extending around the dielectric body and between the bottom and top loops.

Referring initially to FIGS. 1-5, a mobile wireless communications device 20 illustratively includes a portable housing 21, a printed circuit board (PCB) 22 carried within the portable housing, and wireless communications circuitry 23 carried by the PCB within the portable housing. The wireless communications circuitry 23 is carried on a top dielectric layer 25 of the PCB 22 (FIG. 2), and the PCB also has a ground plane 26 on a bottom side thereof (FIG. 3) opposite the top dielectric layer. By way of example, the wireless communications circuitry 23 may comprise cellular communications circuitry, e.g., a cellular transceiver. Other wireless communications circuitry, such as wireless local area network (WLAN) and satellite positioning (e.g., GPS) communications circuitry, may also be used, as will be discussed further below.

The device 20 further illustratively includes a folded monopole antenna 24 coupled to the wireless communications circuitry 23. In particular, the folded monopole antenna 24 illustratively includes a dielectric body 30 having a generally rectangular shape defining a bottom portion 31 adjacent the PCB 22, and a top portion 32 opposite the bottom portion. The antenna 24 also illustratively includes a conductive trace 33 having a bottom loop D adjacent the bottom portion 31 of the dielectric body 30, a top loop A adjacent the top portion 32 of the dielectric body, and an intermediate wrap-around section including elements B, C, E, F and G extending around the dielectric body and between the bottom and top loops, as shown. Considered alternatively, the conductive trace 33 may be conceptualized as the two loop sections A and D, the two U-shaped strips B and C vertically spaced apart between the two loops, and three vertical strips E, F and G for electrically connecting or coupling loops A, D, and strips B, C.

More particularly, in the present example the dielectric body 30 has opposing top and bottom faces 35 and 36, opposing first and second end faces 37 and 38, and opposing first and second side faces 39 and 40. The intermediate wrap-around section (i.e., strips B, C, E, F and G) defines a generally rectangular coil around the first and second end faces 37 and 38 and the first and second side faces 39 and 40. Further, the top loop A illustratively extends along the first and second end faces 37 and 38, the first and second side faces 39 and 40, and the top face 35 of the dielectric body 30. The bottom loop D illustratively extends along the bottom face 36 of the dielectric body 30, as shown. However, these loops may extend along different faces in different embodiments, and more or less loops may also be included. The dielectric body 30 is a cube in the illustrated example (i.e., all of the faces 35-40 have the same dimensions), but other shapes may be used in different embodiments.

The conductive trace 33 further comprises a feed section 41 adjacent the bottom portion 31 of the dielectric body 30 and electrically coupled to the wrap-around intermediate section, and more particularly to the conductive strip C. However, the feed section 41 could be coupled to other portions of the conductive trace 33 in other embodiments. The feed section electrically couples the conductive trace 33 to the wireless communications circuitry 23.

In one embodiment, the wireless communications circuitry 23 includes cellular transmitter/receiver circuitry for communicating over a plurality of cellular communications bands, as will be discussed further below. However, other types of wireless radio frequency (RF) communications circuitry (e.g., Bluetooth/802.11 WLAN circuitry), may also be electrically coupled to the folded monopole antenna 24 in different embodiments, as well as satellite positioning receiver circuitry (e.g., GPS, Galileo, GLONASS, etc.).

As will be appreciated by those skilled in the art, the length of a straight, grounded monopole antenna is ordinarily set to be a quarter wavelength for the given operating frequency to operate in its fundamental mode, and it usually has a relatively narrow bandwidth. To reduce the size of the antenna 24 (i.e., to reduce the amount of PCB 22 surface area required for implementation) and increase its bandwidth, the conductive trace 33 is advantageously "folded" into the cubic structure described above, although it could be etched on a supporting dielectric surface in some embodiments, as will be appreciated by those skilled in the art.

Since the total electrical length of the conductive trace 33 is still the same as an equivalent straight monopole, the conductive trace has the same fundamental operating frequency as a straight strip does, but the overall dimension or size of the antenna 24 is significantly reduced with respect to a comparable traditional monopole element. In addition, the folding of the conductive trace 33 also advantageously enhances bandwidth of the antenna 24, as will be now be discussed with reference to an exemplary implementation of the antenna.

In accordance with one exemplary implementation, the antenna 24 maybe a 0.9 cm×0.9 cm×1 cm cube 30. Such dimensions advantageously allow the antenna 24 to be used in a "smart" antenna array (e.g., adaptive or multiple-input multiple-output (MIMO)) in a handset, whereas a traditional PIFA would typically be too big to form such an array in a handset. The exemplary antenna covered GSM 850/900/1800/1900 and UNITS 2100 frequency bands, and it exhibited desirable gain patterns due to the advantageous current distribution on the conductive trace 33.

Figure 6:
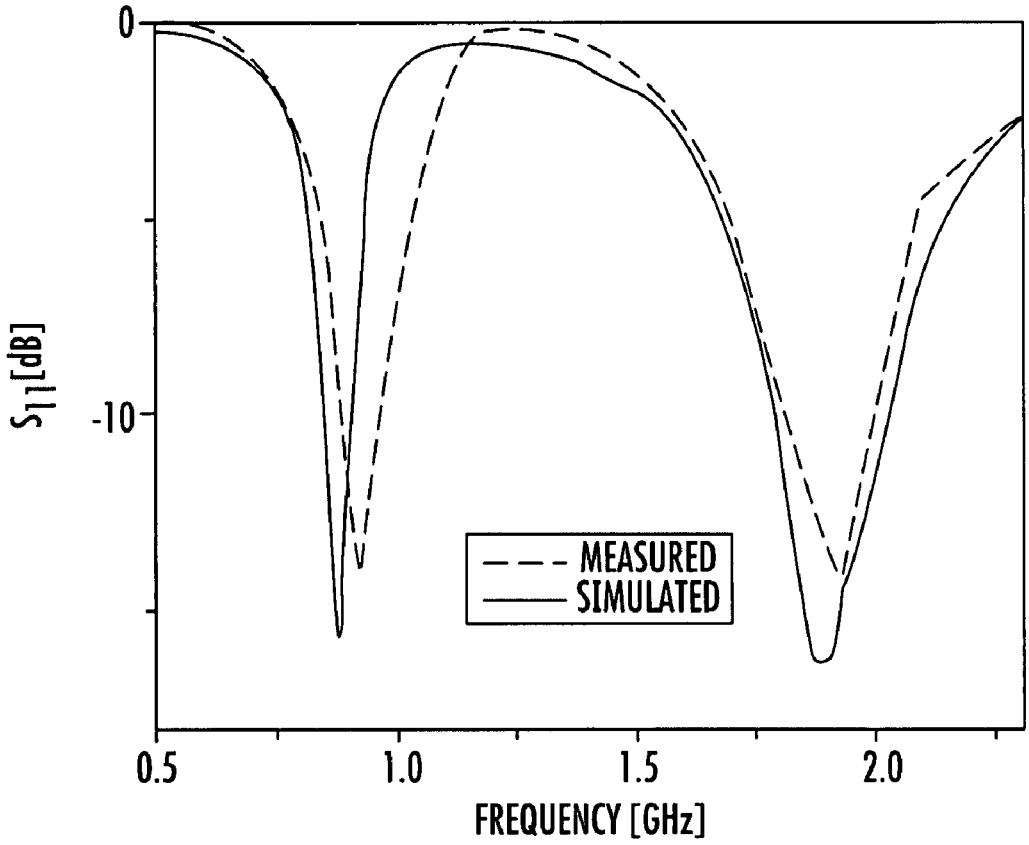
FIG. 6 is a graph of simulated and measured return loss vs. frequency for an embodiment of the folded monopole antenna of FIG. 2.
Figure 7:
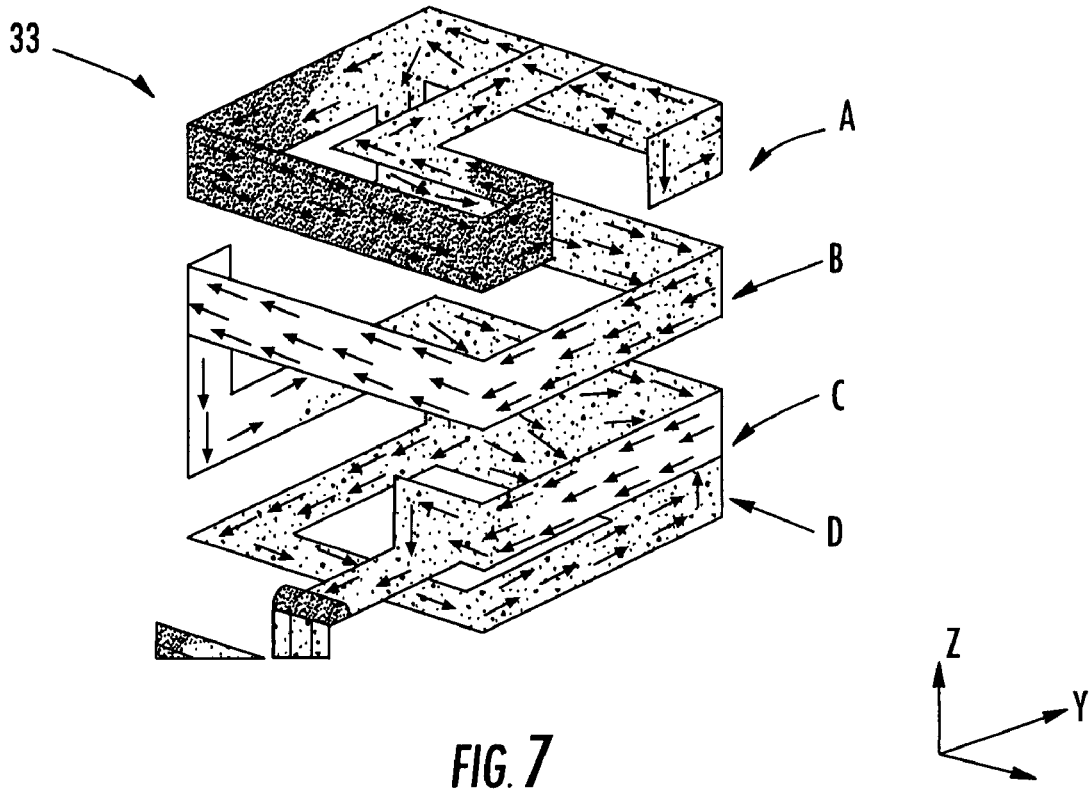
FIGS. 7 and 8 are enlarged perspective views of the antenna of FIG. 2 (with dielectric body removed) showing current distributions for operating frequencies of 900 MHz and 1800 MHz, respectively.
Figure 8:
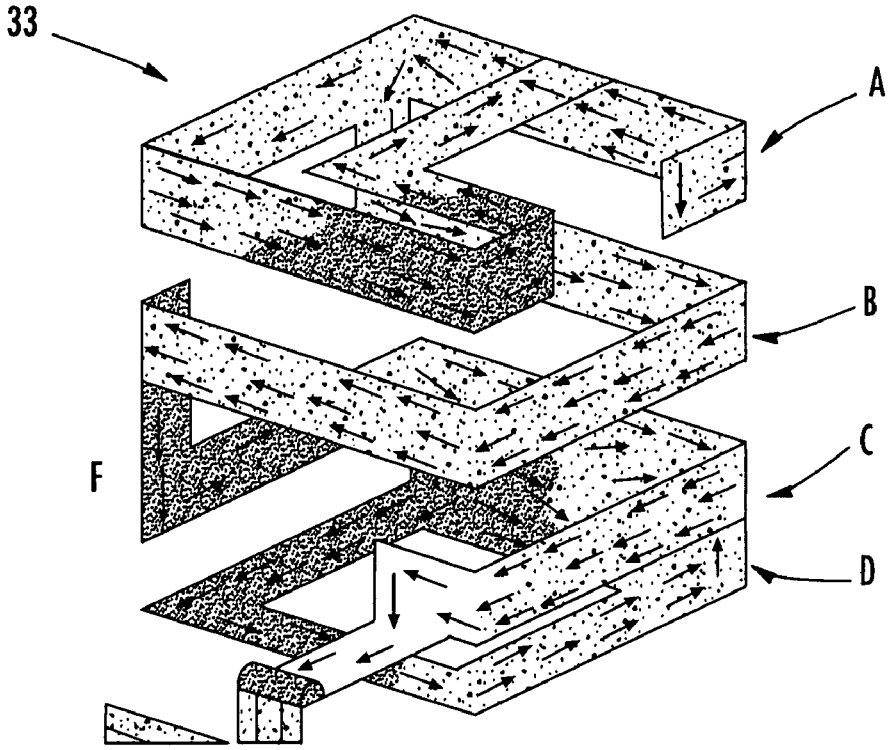

Referring additionally to FIG. 6, both simulated and measured return losses for the exemplary implementation are shown. The relatively close "agreement" between the two curves demonstrates that the antenna 24 provides coverage over GSM/850/900/1800/1900 and UNITS 2100 bands. Simulated electric current distributions for the exemplary embodiment of the antenna 24 are shown in FIGS. 7 and 8 for 900 MHz and 1800 MHz, respectively. It can be seen that the top loop A and the bottom loop D are primarily used for impedance matching. The two U-shaped strips B and C not only contribute to the higher frequency band, but also to the lower operating frequencies as well.

Substantially the entire length of the conductive trace 33 (i.e., from strips A to D) contributes to the low frequency band 850/900. Due to the symmetry, a zero current point occurs at the geometric center point of the vertical connection strip F, although this point shifts for higher frequency bands (e.g., 1800/1900/2100 MHz). In both the high and the low frequency bands, the folded layout causes current flow along couples of strips in the Y and in the X directions to be in-phase, resulting in a relatively high gain radiation pattern, as will be appreciated by those skilled in the art.

Figure 9:
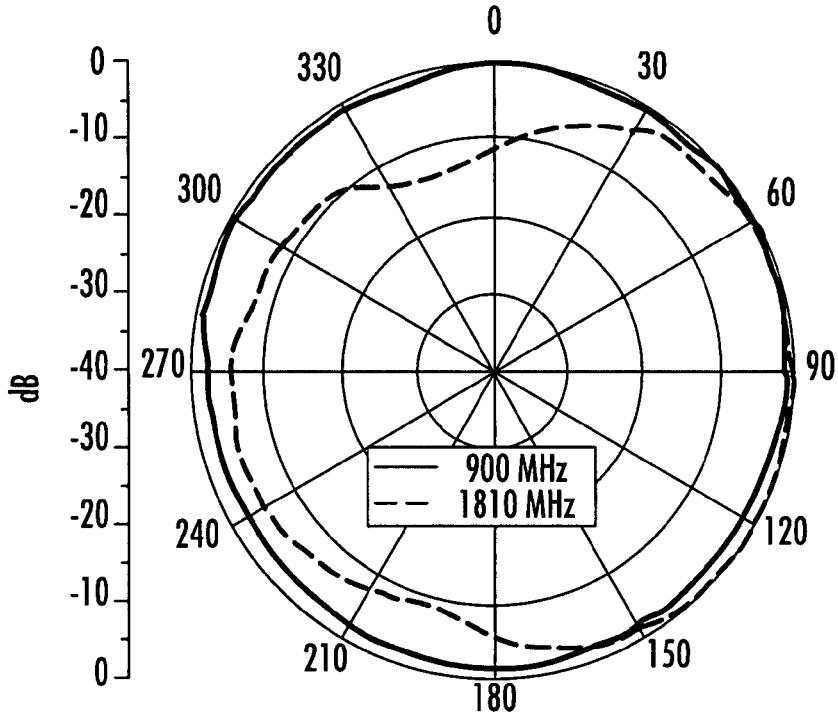
FIG. 9 is a measured radiation pattern diagram for an embodiment of the folded monopole antenna of FIG. 2 in the ZX plane at 900 MHz and 1810 MHz.
Figure 10:
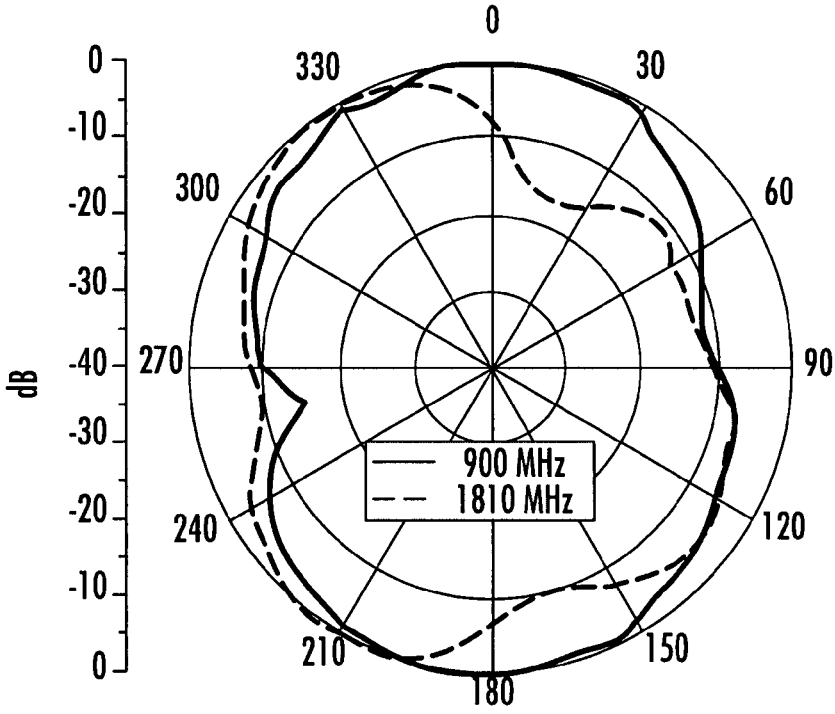
FIG. 10 is a measured radiation pattern diagram for an embodiment of the folded monopole antenna of FIG. 2 in the YZ plane at 900 MHz and 1810 MHz.

Turning now additionally to FIGS. 9 and 10, measured radiation patterns of the exemplary implementation at the two resonant frequencies of 900 MHz and 1810 MHz are shown in the ZX plane (FIG. 9) and the YZ plane (FIG. 10). As may be seen, the antenna 24 has directive radiation in the two radiation planes (ZX and ZY) when it operates at 1.81 GHz. In addition, the antenna 24 also radiates directionally in the ZX plane if the operating frequency is at 900 MHz. It will therefore be appreciated that the antenna 24 may provide relatively high gain radiation in certain embodiments.

The antenna 24 thus has desirable polarization diversity due to the use of the above-described symmetrical strips along X and Y directions. These symmetrical strips allow current to primarily flow along X and Y directions, which advantageously allows 2D polarization diversity to be achieved in the XY plane, as will be appreciated by those skilled in the art.

Moreover, the advantageous use of three-dimensional wrapping reduces the extension of the antenna and at the same time enhances its bandwidth. Stated alternatively, the 3D wrapping allows space to be used efficiently while also increasing bandwidth, which is equivalent to reducing the stored energy around the antenna.

A method for making the antenna 24 may include forming a dielectric body 30 having a generally rectangular shape defining a bottom portion 31 and a top portion 32 opposite the bottom portion. Furthermore, a conductive trace 33 may be formed on the dielectric body 30 having a bottom loop D adjacent the bottom portion 31 of the dielectric body, a top loop adjacent the top portion 32 of the dielectric body, and an intermediate wrap-around section (strips B, C, E, F, and G) extending around the dielectric body and between the bottom and top loops.

Exemplary components of a hand-held mobile wireless communications device 1000 in which one or more of the above-described folded monopole antennas 24 may be used are now described with reference to FIG. 11. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 11:
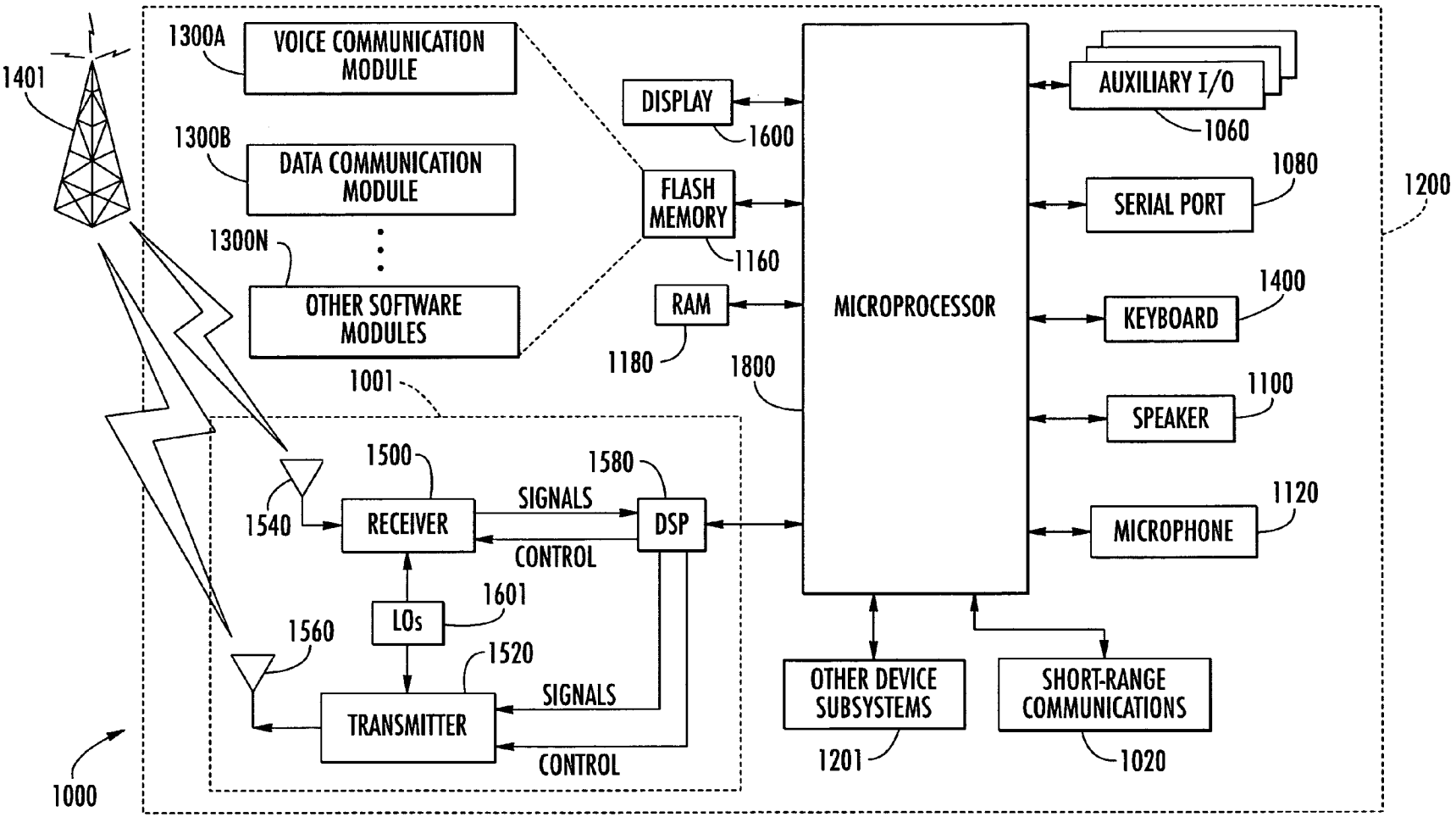
FIG. 11 is a schematic block diagram illustrating exemplary components of a mobile wireless communications device in which the folded monopole antenna of FIG. 2 may be used.

In addition to the processing device 1800, other parts of the mobile device 1000 are shown schematically in FIG. 11. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIN application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, SGPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile communications device, comprising:

a folded monopole antenna that includes a conductive trace folded into a three-dimensional structure around a dielectric body having a plurality of faces; the conductive trace comprising:

a first loop that extends along a first face of said dielectric body;

a second loop that extends along a second face of said dielectric body, the second face being opposite to the first face;

an intermediate wraparound section comprising a first U-shaped strip and a second U-shaped strip extending around said dielectric body to form a rectangular coil between the first loop and the second loop, wherein the first and second U-shaped strips are spaced apart between the first loop and the second loop, and wherein the U-shaped strips are electrically connected to the first and second loops; and a feed section that is electrically coupled to the intermediate wraparound section and wireless communications circuitry disposed on a dielectric layer.

2. The mobile communications device of claim 1, further comprising:

a printed circuit board having a ground plane on a first side and the dielectric layer with wireless communications circuitry on a second side that is opposite the first side, wherein said second side is parallel to said second face of said dielectric body.

3. The mobile communications device of claim 1, further comprising:

a housing, wherein the folded monopole antenna and the wireless communications circuitry are carried within the housing.

4. The mobile communications device of claim 1, wherein the conductive trace further comprises a plurality of strips that electrically connect the first loop and the second loop to the first and second U-shaped strips that extend around the dielectric body.

5. The mobile communications device of claim 1, wherein said three-dimensional structure is a cube.

6. The mobile communications device of claim 1, wherein the wireless communications circuitry comprises a cellular transceiver.

7. The mobile communications device of claim 1, wherein the folded monopole antenna operates over a plurality of radio frequency communications bands.

8. The mobile communications device of claim 7, wherein the plurality of multiple frequency bands include frequency bands 850, 900, 1800 and 1900 of a Global System Mobile Communications system and a frequency band of 2100 of a Universal Mobile Telecommunications System.

9. The mobile communications device of claim 1, wherein said dielectric body has a rectangular shape.

10. The mobile communications device of claim 1, wherein said dielectric body is a cube.

11. An apparatus comprising:

a folded monopole antenna configured as a conductive trace formed onto a three-dimensional dielectric body, said three-dimensional dielectric body having a plurality of surfaces, said conductive trace comprising:

a first loop that extends along a first face of said three-dimensional dielectric body;

a second loop that extends along a second face of said three-dimensional dielectric body, wherein said second face is opposite to the first face; and an intermediate wraparound section comprising a first U-shaped strip and a second U-shaped strip extending around said three-dimensional dielectric body to form a rectangular coil between the first loop and the second loop, wherein said first and said second U-shaped strips are spaced apart between said first loop and said second loop, and wherein said first and said second U-shaped strips are electrically connected to said first and second loops.

12. The apparatus of claim 11, wherein said conductive trace further comprises:

a plurality of strips that electrically connect the first loop to the first and second U-shaped strips that extend around the three-dimensional dielectric body.

13. The apparatus of claim 11, wherein said three-dimensional dielectric body is a cube.

14. The apparatus of claim 11, wherein said folded monopole antenna resonates simultaneously in multiple frequency bands.

15. The apparatus of claim 14, wherein the multiple frequency bands include frequency bands 850, 900, 1800 and 1900 of a Global System Mobile Communications system and a frequency band of 2100 of a Universal Mobile Telecommunications System.

16. The apparatus of claim 11, further comprising:

wireless communications circuitry disposed on a dielectric layer, wherein the wireless communications circuitry is coupled to the folded monopole antenna.

17. The apparatus of claim 16, wherein said conductive trace further comprises:

a feed section that is electrically coupled to the intermediate wraparound section and the wireless communications circuitry.

18. The apparatus of claim 16, further comprising:

a printed circuit board, wherein a ground plane is disposed on a first side, and the dielectric layer with the wireless communications circuitry is disposed on a second side opposite the first side, wherein said second side is parallel to said second face of said dielectric body.

19. The apparatus of claim 18, wherein the three-dimensional dielectric body has a rectangular shape, comprising:

a first planar face substantially parallel to a surface of the printed circuit board;

a second planar face substantially opposite the first planar face;

a third planar face and a fourth planar face connected to and disposed at right angles to the first and second planar faces, the third planar face and fourth planar face being parallel to each other and located at opposing sides of the first planar face and the second planar face; and a fifth planar face and sixth planar face disposed at substantially right angles to the first, second, third, and fourth planar faces, the fifth planar face and sixth planar face being substantially parallel to each other and located at opposite sides of the first planar face and second planar face, wherein the fifth and sixth planar face are connected to the first, second, third and fourth planar faces.

20. The apparatus of claim 19, wherein the second loop extends along edges of the third and fourth planar faces, edges of the fifth and sixth planar faces, and along the second planar face of the three-dimensional dielectric body.

21. The apparatus of claim 16, wherein the wireless communications circuitry comprises a cellular transceiver.

* * * * *